US008395553B2

(12) United States Patent
Oh

(10) Patent No.: US 8,395,553 B2
(45) Date of Patent: Mar. 12, 2013

(54) MOBILE TERMINAL HAVING ANTENNA MOUNTED IN FLEXIBLE PCB OF SIDE KEY

(75) Inventor: Hyun Jong Oh, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 293 days.

(21) Appl. No.: 12/386,283

(22) Filed: Apr. 16, 2009

(65) Prior Publication Data

US 2009/0278752 A1 Nov. 12, 2009

(30) Foreign Application Priority Data

May 8, 2008 (KR) ..... 10-2008-0042656

(51) Int. Cl.
*H01Q 1/24* (2006.01)

(52) U.S. Cl. ..... 343/702; 343/700 MS

(58) Field of Classification Search ..... 343/700 MS, 343/702, 906, 720, 872
See application file for complete search history.

(56) References Cited

U.S. PATENT DOCUMENTS

| | | | | |
|---|---|---|---|---|
| 6,201,501 | B1 * | 3/2001 | Arkko et al. | 343/702 |
| 6,812,898 | B2 * | 11/2004 | Doub et al. | 343/702 |
| 7,184,808 | B2 * | 2/2007 | Shoji | 455/575.7 |
| 2007/0152888 | A1 * | 7/2007 | Scarpelli | 343/702 |
| 2008/0074329 | A1 * | 3/2008 | Caballero et al. | 343/702 |

* cited by examiner

*Primary Examiner* — Tan Ho

(57) ABSTRACT

A mobile terminal wherein a second antenna is mounted in a flexible PCB of a side key positioned at a location separated from a first antenna is provided. The mobile terminal includes: a main body; the first antenna and a printed circuit board (PCB) positioned on the inside of the main body; a side key positioned at a side surface of the outside of the main body; and a flexible PCB of the side key positioned on the inside of the main body. The flexible PCB of the side key including the second antenna. Therefore, by mounting a second antenna in a flexible PCB of a side key positioned at a location separated from a first antenna, an emission and reception performance of the first antenna and the second antenna can be improved.

20 Claims, 4 Drawing Sheets

MOBILE TERMINAL HAVING ANTENNA MOUNTED IN FLEXIBLE PCB OF SIDE KEY

CROSS-REFERENCE TO RELATED APPLICATION(S) AND CLAIM OF PRIORITY

The present application claims priority to an application entitled "MOBILE TERMINAL HAVING ANTENNA MOUNTED IN FLEXIBLE PCB OF SIDE KEY" filed in the Korean Intellectual Property Office on May 8, 2008 and assigned Serial No. 10-2008-0042656, the contents of which are incorporated herein by reference.

TECHNICAL FIELD OF THE INVENTION

The present invention relates to a mobile terminal and, more particularly, to a mobile terminal wherein a second antenna is mounted in a flexible PCB of a side key positioned at a location separated from a first antenna.

BACKGROUND OF THE INVENTION

In general, a mobile terminal is an electronic device with which a user can perform a function such as wireless communication, network connection, and digital broadcasting reception almost regardless of time and location. The mobile terminal has an antenna in order to perform wireless communication. The antenna is a device for transmitting and receiving electromagnetic waves outside the mobile terminal in order to perform the wireless communication. The antenna has various shapes according to a frequency or wavelength to be used.

Presently, the mobile terminal has a small size in order to be carried conveniently and to improve the appearance. However, in addition to a wireless communication function, the mobile terminal has complex functions such as wireless Internet communication, navigation, global positioning system (GPS), digital broadcasting reception, and Bluetooth functions. Accordingly, the quantity of frequency bands used by one mobile terminal increases to two or three. As the quantity of used frequency band increases, the quantity of necessary antennas increases, and therefore the size of the mobile terminal also increases.

FIG. 1 illustrates a cross-sectional view for an antenna carrier of a conventional mobile terminal wherein a main first antenna and an auxiliary second antenna are mounted.

Referring to FIG. 1, a first antenna 110 and a second antenna 120 are mounted in a carrier 100. The carrier 100 is mounted in a mobile terminal. The first antenna 110 enables the mobile terminal to perform wireless communication. The second antenna 120 is a Bluetooth antenna or an assisted global positioning system (AGPS) antenna. When the first antenna 110 and the second antenna 120 are mounted in one carrier 100, the two antennas 110 and 120 are positioned adjacently to each other. Therefore, coupling occurs between the two antennas 110 and 120, and, thus, a performance of the antennas 110 and 120 deteriorates. In order to overcome the problem, two separated antenna carriers are mounted in the mobile terminal, and, therefore, the size of the mobile terminal increases.

SUMMARY OF THE INVENTION

To address the above-discussed deficiencies of the prior art, it is a primary object to provide a mobile terminal in which a second antenna is mounted in a flexible PCB of a side key positioned at a location separated from a first antenna.

The present invention further provides a mobile terminal having a reduced size by minimizing the quantity of antenna carriers mounted therein.

In accordance with an aspect of the present invention, a mobile terminal includes: a main body; a first antenna and a printed circuit board (PCB) positioned at the inside of the main body; a side key positioned at a side surface of the outside of the main body; and a flexible PCB of the side key positioned at the inside of the main body, the flexible PCB of the side key having an interface unit formed at one end and connected to the PCB, a contact point formed at the other end and connected to the side key, and a second antenna formed from one end to the other end.

Preferably, the flexible PCB of the side key further includes a ground line formed from the interface unit in a direction towards the second antenna and contacting with the second antenna.

Preferably, the second antenna is formed along an edge of the flexible PCB of the side key.

Preferably, the second antenna has a meandering shape.

Preferably, the side key is one of a volume key, a camera key, and a power supply key.

Preferably, the first antenna and the second antenna are antennas for different frequency bands.

Preferably, the second antenna is an assisted global positioning system (AGPS) antenna.

Preferably, the first antenna is mounted in a carrier positioned at a location within the main body separated from the flexible PCB of the side key.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 2 through 5, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged mobile communications device.

Figure 1:
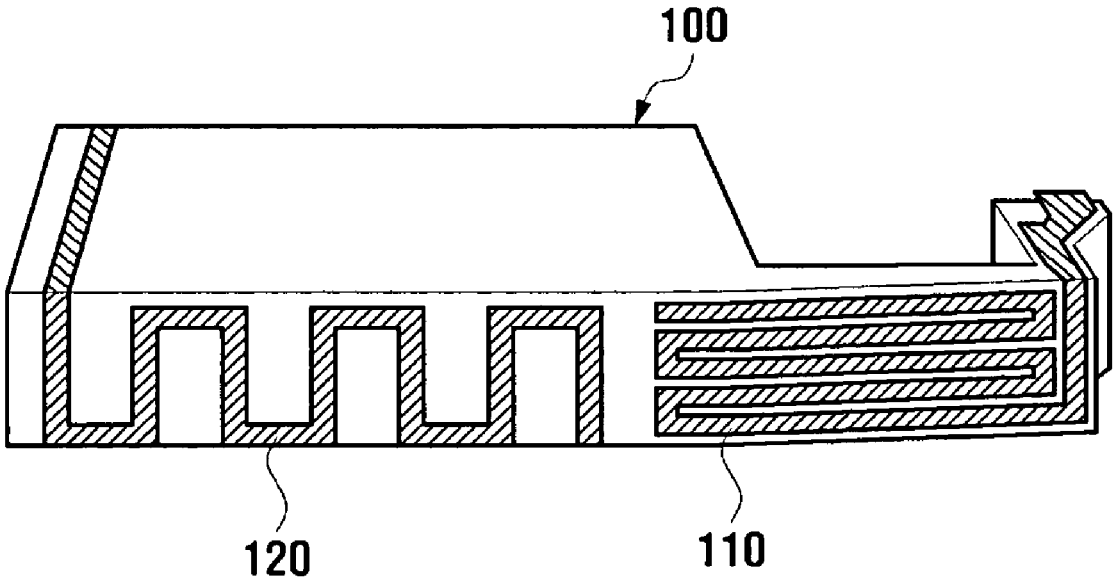
FIG . 1 (CONVENTIONAL ART)
FIG. 1 illustrates a cross-sectional view for an antenna carrier of a conventional mobile terminal in which a main first antenna and an auxiliary second antenna are mounted.
Figure 2:
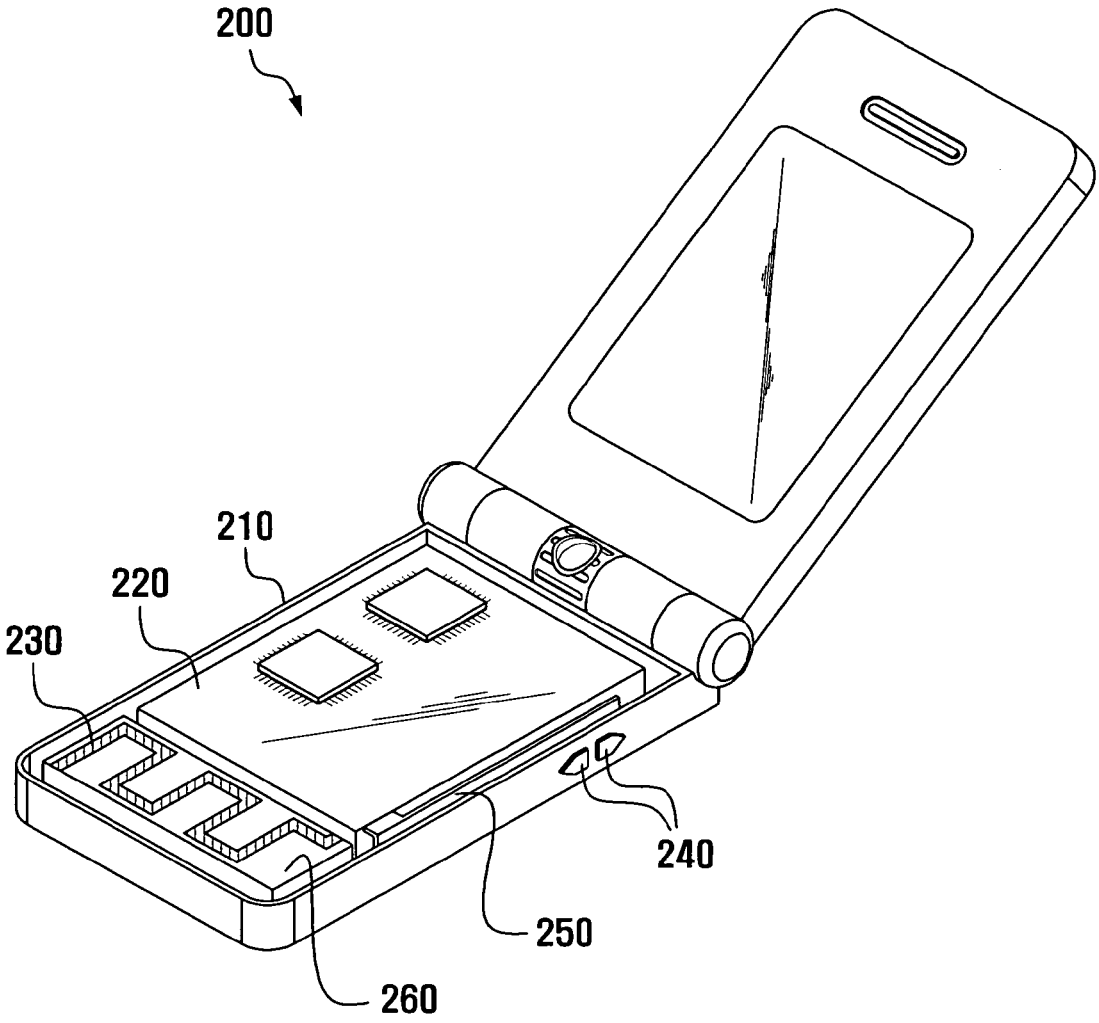
FIG. 2 illustrates a partially cut-away perspective view of a mobile terminal according to an exemplary embodiment of the present invention.

FIG. 2 illustrates a partially cut-away perspective view of a mobile terminal according to an exemplary embodiment of the present invention.

Referring to FIG. 2, a mobile terminal 200 includes a main body 210, PCB 220, first antenna 230, side key 240, and flexible PCB 250 of the side key 240. The PCB 220 and the first antenna 230 are positioned at the inside of the main body 210. In the present exemplary embodiment, the first antenna 230 is mounted in a carrier 260, however in other embodiment's a mounting location of the first antenna is not limited thereto. The carrier 260 is positioned at a location separated from the flexible PCB 250 of the side key 240. The first antenna 230 enables the mobile terminal 200 to perform wireless communication. A length of the first antenna 230 is set according to a frequency band of a wireless signal to be transmitted and received.

The side key 240 is positioned at a side surface of the outside of the main body 210. In the present exemplary embodiment, the side key 240 is a volume key, however in other exemplary embodiments, the side key may be a camera key or a power supply key. One end of the flexible PCB 250 of the side key 240 is connected to the PCB 220 and the other end is connected to the side key 240. The flexible PCB 250 of the side key 240 electrically connects the PCB 220 and the side key 240.

Figure 3:
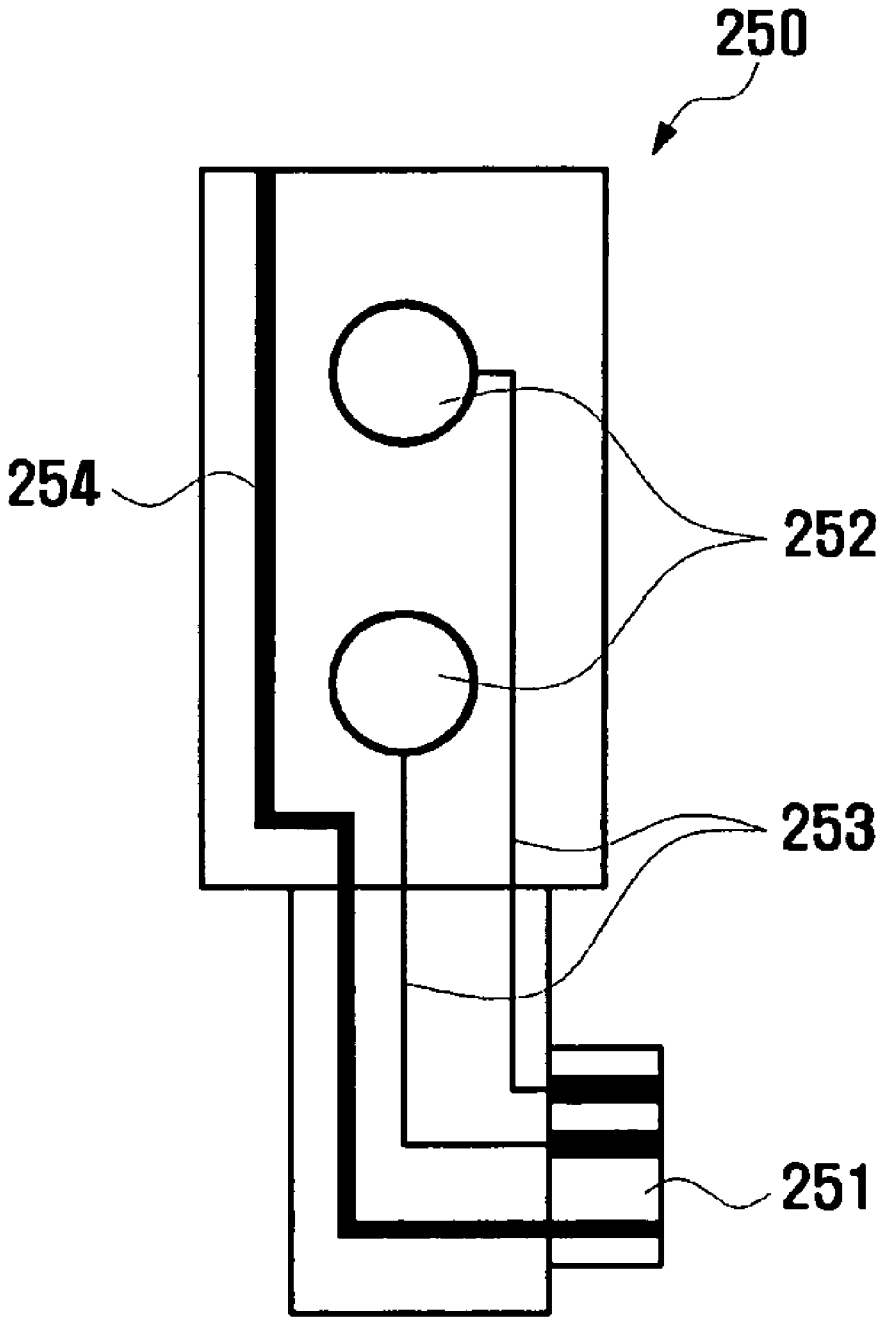
FIG. 3 illustrates a plan view for a flexible PCB of a side key of the mobile terminal of FIG. 2.

FIG. 3 is a plan view illustrating the flexible PCB of the side key of the mobile terminal 200 of FIG. 2.

Referring to FIG. 3, an interface unit 251 is formed at one end of the flexible PCB 250 of the side key 240. The flexible PCB 250 of the side key 240 is connected to the PCB 220 through the interface unit 251. Two contact points 252 are formed at the other end of the flexible PCB 250 of the side key 240. The contact points 252 are each connected to the interface unit 251 through connection lines 253. If the user presses the side key 240, the side key 240 contacts with one of the contact points 252, and an input signal of the side key 240 is, thus, transmitted to the PCB 220.

The flexible PCB 250 of the side key 240 includes a second antenna 254. The second antenna 254 is formed from one end of the flexible PCB 250 of the side key 240 to the other end thereof. A length of the second antenna 254 is set according to a frequency band of a wireless signal to be transmitted and received. The second antenna 254 is formed along an edge of the flexible PCB 250 of the side key 240. By forming the second antenna 254 at an edge of the flexible PCB 250 of the side key 240, the second antenna 254 is less influenced by the contact point 252 and the connection line 253.

The first antenna 230 and the second antenna 254 are antennas for different frequency bands. In the present exemplary embodiment, the second antenna 254 is an AGPS antenna, however in other embodiments the second antenna is not limited thereto. The first antenna 230 is mounted in the carrier 260 and the second antenna 254 is mounted in the flexible PCB 250 of the side key 240. Because the carrier 260 and the flexible PCB 250 of the side key 240 are positioned at separated locations within the main body 210 of the mobile terminal 200, the first antenna 230 and the second antenna 254 are also positioned at separated locations. Therefore, the first antenna 230 and the second antenna 254 are not influenced by each other.

Further, because the flexible PCB 250 of the side key 240 is connected to the side key 240 positioned at a side surface of the outside of the main body 210, the flexible PCB 250 of the side key 240 is positioned at a location adjacent to the outside of the main body 210, and therefore the second antenna 254 is also positioned adjacent to the outside of the main body 210. Therefor, the second antenna 254 is less influenced by the PCB 220.

Figure 4:
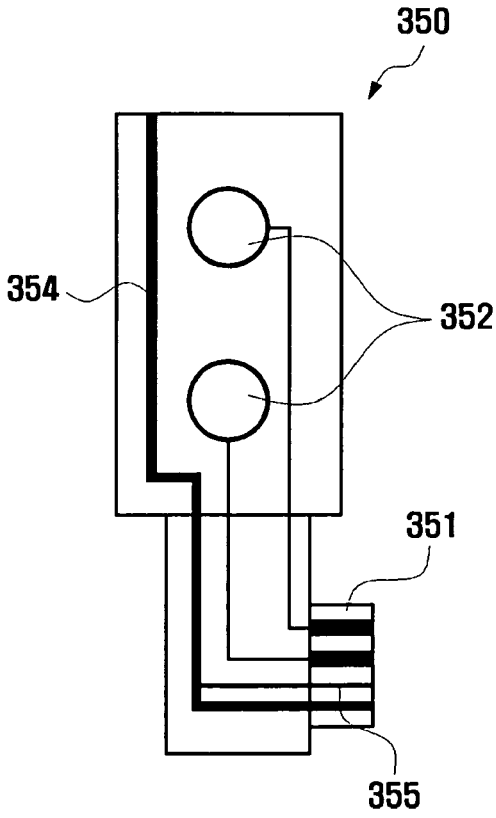
FIG. 4 illustrates a plan view for a flexible PCB of a side key of a mobile terminal according to another exemplary embodiment of the present invention.

FIG. 4 is a plan view illustrating a flexible PCB of a side key of a mobile terminal according to another exemplary embodiment of the present invention.

Referring to FIG. 4, a flexible PCB 350 of a side key includes a ground line 355. The ground line 355 is formed from an interface unit 351 in a direction towards a second antenna 354, and contacts with the second antenna 354.

By contacting the second antenna 354 with the ground line 355, the second antenna 354 becomes a planar inverted frequency antenna (PIFA). Because the PIFA has a simple structure and a wide bandwidth, the PIFA is generally used in a wireless communication field.

Figure 5:
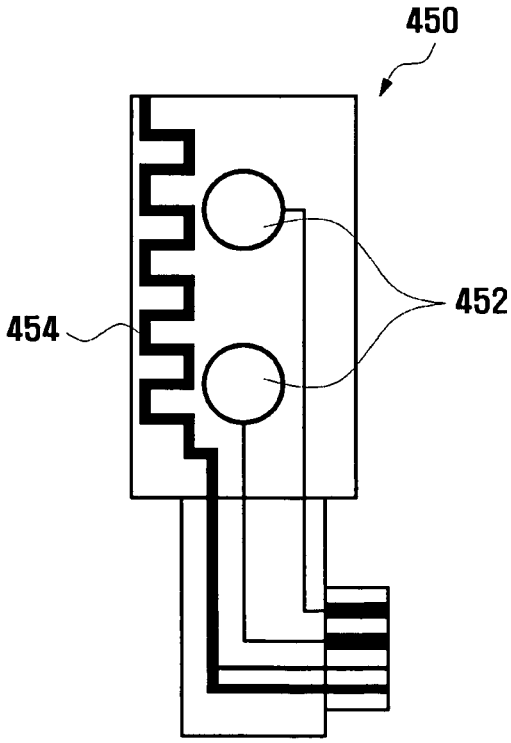
FIG. 5 illustrates a plan view for a flexible PCB of a side key of a mobile terminal according to another exemplary embodiment of the present invention.

FIG. 5 is a plan view illustrating a flexible PCB of a side key of a mobile terminal according to another exemplary embodiment of the present invention.

Referring to FIG. 5, a second antenna 454 mounted in a flexible PCB 450 of a side key has a meandering shape. A length of the second antenna 454 is set according to a frequency band of a wireless signal to be transmitted and received. When the second antenna 454 is used for a low frequency wireless signal, the length of the second antenna 454 should be extended. However, space for mounting the second antenna 454 within the flexible PCB 450 of the side key 240 is limited. Accordingly, by forming the second antenna 454 in a meandering shape, the second antenna 454 can be formed with a desired length.

The mobile terminal according to the present exemplary embodiment is a mobile electronic device, such as a mobile phone, personal digital assistant (PDA), digital broadcasting receiver, and portable multimedia player (PMP).

As described above, according to the present invention, because a second antenna is mounted in a flexible PCB of a side key positioned at a location separated from a first antenna, an emission and reception performance of the first antenna and the second antenna can be improved.

Further, as the quantity of antenna carriers mounted in the mobile terminal is reduced, a size of the mobile terminal can be reduced.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A mobile terminal comprising:

a main body;

a first antenna and a printed circuit board (PCB) positioned at the inside of the main body;

a side key positioned at a side surface of the outside of the main body; and a flexible PCB associated with the side key and positioned at the inside of the main body adjacent to the side key, the flexible PCB having an interface unit formed at one end and connected to the PCB, one or more of contact points selectably coupled to the side key, and a second antenna formed from one end to the other end.

2. The mobile terminal of claim 1, wherein the flexible PCB further comprises a ground line formed from the interface unit in a direction towards the second antenna and contacting with the second antenna.

3. The mobile terminal of claim 1, wherein the second antenna is formed along an edge of the flexible PCB.

4. The mobile terminal of claim 1, wherein the second antenna has a meandering shape.

5. The mobile terminal of claim 1, wherein the side key is one of a volume key, a camera key, and a power supply key.

6. The mobile terminal of claim 1, wherein the first antenna and the second antenna are antennas for different frequency bands.

7. The mobile terminal of claim 6, wherein the second antenna is an assisted global positioning system (AGPS) antenna.

8. The mobile terminal of claim 1, wherein the first antenna is mounted in a carrier positioned at a location within the main body separated from the flexible PCB.

9. The mobile terminal of claim 1, wherein the flexible PCB further comprises a ground line formed from the interface unit and coupled to the second antenna.

10. The mobile terminal of claim 9, wherein the second antenna is a planar inverted frequency antenna (PIFA).

11. An antenna device for a mobile terminal, the antenna device comprising:

a first antenna and a printed circuit board (PCB) disposed at a first location;

a side key positioned disposed at a second location; and a flexible PCB associated with the side key and positioned along an inside surface of the mobile terminal adjacent to the side key, the flexible PCB having an interface unit formed at one end and connected to the PCB, one or more contact points selectably coupled to the side key, and a second antenna formed from one end to the other end.

12. The antenna device of claim 11, wherein the flexible PCB further comprises a ground line formed from the interface unit in a direction towards the second antenna and contacting with the second antenna.

13. The antenna device of claim 11, wherein the second antenna is formed along an edge of the flexible PCB.

14. The antenna device of claim 11, wherein the second antenna has a meandering shape.

15. The antenna device of claim 11, wherein the side key is one of a volume key, a camera key, and a power supply key.

16. The antenna device of claim 11, wherein the first antenna and the second antenna are antennas for different frequency bands.

17. The antenna device of claim 11, wherein the second antenna is an assisted global positioning system (AGPS) antenna.

18. The antenna device of claim 11, wherein the first antenna is mounted in a carrier positioned at a location within the main body separated from the flexible PCB.

19. The antenna device of claim 11, wherein the flexible PCB further comprises a ground line formed from the interface unit and coupled to the second antenna.

20. The antenna device of claim 19, wherein the second antenna is a planar inverted frequency antenna (PIFA).

* * * * *